US008277911B2

(12) United States Patent
Ono

(10) Patent No.: US 8,277,911 B2
(45) Date of Patent: Oct. 2, 2012

(54) ANTICORROSION COMPOSITION

(75) Inventor: Yoshinori Ono, Osaka (JP)

(73) Assignee: Rengo Co., Ltd., Osaka-shi (JP)

( * ) Notice: Subject to any disclaimer, the term of this patent is extended or adjusted under 35 U.S.C. 154(b) by 203 days.

(21) Appl. No.: 12/308,516

(22) PCT Filed: Jun. 27, 2007

(86) PCT No.: PCT/JP2007/062856

§ 371 (c)(1),
(2), (4) Date: Dec. 17, 2008

(87) PCT Pub. No.: WO2008/004467

PCT Pub. Date: Jan. 10, 2008

(65) Prior Publication Data

US 2010/0230478 A1 Sep. 16, 2010

(30) Foreign Application Priority Data

Jul. 7, 2006 (JP) ..... 2006-188135

(51) Int. Cl.
*C09K 3/00* (2006.01)
*C23F 11/00* (2006.01)

(52) U.S. Cl. ..... 428/35.7; 106/14.05; 106/14.11; 106/14.28; 252/387

(58) Field of Classification Search ..... 428/35.8, 428/35.7; 106/18.32, 14.05, 14.11, 14.28; 252/387

See application file for complete search history.

(56) References Cited

U.S. PATENT DOCUMENTS

| | | | |
|---|---|---|---|
| 2,643,176 | A | 6/1953 | Wachter et al. |
| 2,672,427 | A | 3/1954 | Bauling et al. |
| 2,898,260 | A | 8/1959 | Berliner |
| 2,984,581 | A | 5/1961 | Jayme et al. |
| 3,652,354 | A | 3/1972 | Su |
| 4,175,148 | A | 11/1979 | Luck et al. |
| 4,305,989 | A | 12/1981 | Luck et al. |
| 4,622,248 | A | 11/1986 | Leach et al. |
| 4,857,322 | A | 8/1989 | Goettsche et al. |
| 4,929,454 | A | 5/1990 | Findlay et al. |
| 4,935,457 | A | 6/1990 | Metzner et al. |
| 5,276,029 | A | 1/1994 | Goettsche et al. |
| 5,426,121 | A | 6/1995 | Bell |
| 5,478,598 | A | 12/1995 | Shiozawa |
| 5,569,542 | A | 10/1996 | Burton et al. |
| 5,635,217 | A | 6/1997 | Goettsche et al. |
| 5,853,766 | A | 12/1998 | Goettsche et al. |
| 6,306,202 | B1 | 10/2001 | West |
| 6,340,384 | B1 | 1/2002 | Walker |
| 6,352,583 | B1 | 3/2002 | Goettsche et al. |
| 6,541,038 | B1 | 4/2003 | Tanaka et al. |
| 6,579,622 | B2 | 6/2003 | West |
| 6,843,837 | B2 | 1/2005 | Zhang et al. |
| 6,919,111 | B2 | 7/2005 | Swoboda et al. |
| 6,978,724 | B2 | 12/2005 | Anderson et al. |
| 7,001,452 | B2 | 2/2006 | Zhang et al. |
| 2005/0000387 | A1 * | 1/2005 | Wang et al. ..... 106/18.32 |

FOREIGN PATENT DOCUMENTS

| | | |
|---|---|---|
| DE | 942 892 | 5/1956 |
| DE | 33 28 199 | 2/1984 |
| DE | 39 11 091 | 10/1990 |
| EP | 0 086 245 | 5/1987 |
| EP | 0 861 925 | 1/2002 |
| EP | 1 493 846 | 1/2005 |
| EP | 1 726 688 | 11/2006 |
| GB | 627 801 | 8/1949 |
| GB | 693 602 | 7/1953 |
| GB | 819 782 | 9/1959 |
| GB | 1 105 329 | 3/1968 |
| GB | 1 134 742 | 11/1968 |
| JP | 63-99399 | 4/1988 |
| JP | 1-58471 | 4/1989 |
| JP | 5-36559 | 5/1993 |
| JP | 5-61947 | 9/1993 |
| JP | 2003-171899 | 6/2003 |
| JP | 2004-277153 | 10/2004 |

OTHER PUBLICATIONS

International Search Report dated Oct. 9, 2007 in the International (PCT) Application PCT/JP2007/062856 of which the present application is the U.S. National Stage.

Chinese Office Action issued Apr. 22, 2010 in corresponding Chinese Application No. 200780025181.1 (with English translation).

Grünecker Kinkeldey Stockmair & Schwanhäusser letter regarding Patent Search, dated May 24, 2007.

Abstract of JP 10-324983, Dec. 8, 1998.

Extended European Search Report (in English language) issued May 7, 2012 in corresponding European Patent Application No. 07 76 7659.

* cited by examiner

*Primary Examiner* — Rena Dye
*Assistant Examiner* — Ellen S Wood
(74) *Attorney, Agent, or Firm* — Wenderoth, Lind & Ponack, L.L.P.

(57) ABSTRACT

An anticorrosion composition is manufactured which contains a water-soluble inorganic acid salt (a) containing at least one of copper and tin, an alkaline component (b), and a binder (c), the equivalent ratio of the water-soluble inorganic acid salt (a) and the alkaline component (b) being 2:0.25 to 2:2. This anticorrosion composition is applied to a fiberboard to manufacture an anticorrosion fiberboard which can absorb reducing sulfur compounds produced from the fiberboard or already present in the atmosphere.

3 Claims, No Drawings

ANTICORROSION COMPOSITION

TECHNICAL FIELD

This invention relates to preventing corrosion of the contents of a package resulting from reducing sulfur compounds produced from fiberboards such as corrugated fiberboards or present in the atmosphere.

BACKGROUND ART

Generally, various industrial products and parts are stored or transported in corrugated fiberboard boxes. In this case, such industrial products and parts tend to partially corrode or deteriorate. This is a reaction resulting from reducing sulfur compounds produced from the corrugated fiberboards, such as hydrogen sulfide and mercaptan. This reaction is especially remarkable if these contents contain silver or copper. Rubbers used as cushions also produce reducing sulfur compounds if their elasticity is given by vulcanization.

Reducing sulfur compounds are produced from corrugated fiberboards because linerboard for such corrugated fiberboards is formed by the kraft process. In the kraft process, wood material is cooked under pressure in a solution of a mixture of sodium hydroxide and sodium sulfide, and formed into a pulp after removing lignin. For improved strength of the fiberboard, it is necessary to remove lignin, which is involved in binding fibers together. But during this process, lignin that is bound to sulfur remains. Thus, when fiberboards such as kraft paper and linerboard are formed from such a pulp, lignin bound to sulfur or sulfur compounds derived from sodium sulfide remain in the pulp. When the paperboard product is placed in a high-temperature, high-humidity environment, such sulfur compounds tend to be liberated from fibers, thus corroding e.g. industrial products in the fiberboard package. Especially if the contents of the package are electric devices, even if a small amount of sulfides, which are produced as a result of reaction with hydrogen sulfide, are present on contact points, the contact resistance increases. Also, sulfides present on conductive wires tend to increase the electrical resistance, and the possibility of wire breakage. Thus, corrosion resulting from reducing sulfur compounds such as hydrogen sulfide can lead to fatal defects of electric devices and their parts.

But because reducing sulfur compounds are produced from fiberboards themselves, it is difficult to prevent production of such compounds. Thus, consideration is now being given to absorbing reducing sulfur compounds in the corrugated fiberboard before being released into the atmosphere, thereby preventing damage to products in the package. For example, Patent document 1 proposes to apply a composition containing activated charcoal, metallic compounds selected from the group consisting of copper, nickel, cobalt, iron, zinc, tin, manganese, vanadium, molybdenum, platinum, sodium, potassium, calcium, barium and cadmium, and a binder to the fiberboards or to impregnate the fiberboards with such a composition.

On the other hand, deodorants for absorbing and adsorbing hydrogen sulfide are required in various fields. For example, Patent document 2 discloses an aqueous deodorant solution containing zinc sulfate, alkaline compounds and a pH adjuster for adjusting the pH value to 5 to 8.

Patent document 1: JP5-36559B

Patent document 2: JP5-61947B

DISCLOSURE OF THE INVENTION

Object of the Invention

But the composition disclosed in Patent document 1 cannot sufficiently absorb reducing sulfur compounds produced from multilayered fiberboards or thick fiberboards because such fiberboards produce larger amounts of reducing sulfur compounds, though it is effective for older single-layered corrugated fiberboards.

If the amount of the composition applied to the fiberboards is increased in order to increase the absorbing amount of sulfur compounds, the water content that has to be evaporated to completely dry the composition also increases, which significantly lowers productivity. Also, because it is difficult to sufficiently dry the composition, it may peel off and contaminate the contents of the packages. Therefore, compositions having a higher ability to absorb reducing sulfur compounds are desired. Also, because today's corrugated fiberboards are increasingly formed of recycled paper, the amounts of reducing sulfur compounds in the paper are not uniform, so that such compounds are sometimes not sufficiently absorbed. Further, if reducing sulfur compounds are already present in the atmosphere, it is necessary to absorb them as quickly as possible to protect the contents. Thus, compositions that can absorb reducing sulfur compounds at a higher rate are desirable.

If the deodorant disclosed in Patent document 2 is applied to fiberboards, it can only deodorize the fiberboards and cannot sufficiently prevent corrosion of the contents.

Therefore, an object of the present invention is to provide an anticorrosion composition which can more reliably absorb reducing sulfur compounds produced from fiberboards by applying a smaller amount of such a composition.

Means to Achieve the Object

To achieve this object, the present invention provides an anticorrosion composition containing a water-soluble inorganic acid salt (a) containing at least one of copper and tin, an alkaline component (b), and a binder (c), the equivalent ratio of the water-soluble inorganic acid salt (a) and the alkaline component (b) being 2:0.25 to 2:2.

That is, noting that the absorption of reducing sulfur compounds is the reaction between reducing sulfur compounds and a metal, it has been discovered that an inorganic acid salt of copper and tin scarcely liberates reducing sulfur compounds once the former adsorbs the latter, while conventional compounds of other metals tend to liberate reducing sulfur compounds after adsorbing them, so that such compounds cannot sufficiently adsorb reducing sulfur compounds. Also, it has been discovered that by changing the equivalent ratio that shows the quantitative relationship between the reactants produced by the above chemical reaction, there is an optimum range of the content of the alkaline component within which the composition exhibits the maximum ability to absorb and remove reducing sulfur compounds.

ADVANTAGES OF THE INVENTION

By applying the anticorrosion composition according to the present invention to a fiberboard such as linerboard, it is possible to reliably absorb large amounts of reducing sulfur compounds produced from fiberboards. This suppresses corrosion of industrial products and parts packaged in an anticorrosion corrugated fiberboard or the like which is formed of the above-described anticorrosion fiberboard due to reducing sulfur compounds.

BEST MODE FOR EMBODYING THE INVENTION

The present invention is now described in more detail.

The present invention is directed to an anticorrosion composition containing a water-soluble inorganic acid salt (a), an alkaline component (b), and a binder (c).

The above water-soluble inorganic acid salt (a) is an inorganic salt containing at least one of copper and tin, and easily soluble or soluble in water. Specific such inorganic salts include sulfate, carbonate, chloride or nitrate. But in the case of weak acid salts such as carbonate, it may be difficult to achieve the target pH value. Thus, the acid salt (a) is preferably a strong acid salt. Also, because an organic salt acid such as acetate is decomposed by heat, the acid salt (a) has to be an inorganic acid salt. Further, if the acid salt (a) is an oxide, the removing speed is slow, and if it is a hydroxide, it tends to be decomposed by heat and deteriorate. Thus, they are both not preferable. The acid salt (a) may contain both copper and tin, or may comprise inorganic salts containing copper and tin, respectively.

When copper and tin are compared, copper is preferable because copper can absorb and remove reducing sulfur compounds more effectively. Copper sulfate is particularly preferable because it is easily soluble in water and can be easily prepared. The term "soluble in water" herein used refers to a solubility of not less than 0.5 g/100 ml at room temperature. Such water solubility is desirable because in a high-temperature, high-humidity environment, where metals tend to corrode remarkably, the composition can sufficiently perform its expected function because it is sufficiently water-soluble. Also, if the composition is sufficiently water-soluble, a solution can be easily prepared.

As metals usable in the acid salt (a) other than copper and tin, nickel, zinc, cobalt, iron, manganese, sodium, potassium, calcium and barium are not suitable, because products produced by the reaction of these metals with hydrogen sulfide are unstable in the air, so that these products tend to redecompose, causing detachment of the hydrogen sulfide. Mercury, lead and cadmium are not suitable either because these metals are highly poisonous. Bismuth is not preferable because its effect is insufficient. For vanadium, molybdenum and platinum, their properties are unknown and therefore whether they are preferable or not is unknown either. Silver can adsorb gas. But silver is expensive and is difficult to use because it degenerates by light.

The alkaline component (b) is a compound that shows basic properties when dissolved into the composition, and may be sodium hydroxide, potassium hydroxide, barium hydroxide, ammonium, potassium acetate, sodium acetate, sodium carbonate, potassium carbonate, sodium hydrogen carbonate or potassium hydrogen carbonate, or a combination thereof. Among them, sodium hydroxide, sodium carbonate and sodium hydrogen carbonate are preferable because they are inexpensive and easy to handle.

The binder (c) may be water-soluble or water-dispersible. Specifically, the binder (c) may be a synthetic rubber latex such as styrene-butadiene latex, poly(meta)acrylic acid ester or a copolymer latex of poly(meta)acrylic acid ester and styrene or vinyl acetate, polyurethane, partially saponified polyvinyl acetate, polyvinyl alcohol, a fiber derivative such as methyl cellulose or carboxymethyl cellulose, or a water-soluble polymer such as sodium polyacrylate.

The equivalent ratio of the water-soluble inorganic acid salt (a) and the alkaline component (b) of the anticorrosion composition according to the present invention has to be 2:0.25 to 2:2, preferably 2:0.6 to 2:1.5. If the content of the alkaline component is less than 2:0.25 in equivalent ratio, i.e. the content of the alkaline component (b) is too low, the ability of the composition to absorb reducing sulfur compounds is so low that the composition cannot sufficiently prevent corrosion of the contents of the package. If the content of the alkaline component (b) is higher than 2:2, the liquid physical properties of the anticorrosion composition obtained tend to be unstable, so that the fiberboard to which such a composition is applied tend to suffer from marked deteriorations in properties and performance, thus making it impossible to achieve sufficient anticorrosion properties.

The content of the water-soluble inorganic acid salt (a) based on 100% by weight of the entire aqueous composition is preferably not less than 0.5% by weight, more preferably not less than 2% by weight. If less than 0.5% by weight, its concentration is so low that it cannot sufficiently perform its function of absorbing and removing reducing sulfur compounds. Further, its content is preferably not more than 50% by weight, more preferably not more than 30% by weight. If over 50% by weight, its content exceeds the upper limit of the solubility and thus such a content is not practical.

The content of the binder (c) is preferably not less than 0.1% by weight, more preferably not less than 0.2% by weight. If less than 0.1% by weight, the viscosity of the anticorrosion composition according to the present invention is so low that its solid content cannot be retained with sufficient force. Thus, the solid content tends to peel off and contaminate other products. This makes it difficult to apply the composition to e.g. fiberboards. Further, the content of the binder is preferably not more than 5% by weight, more preferably not more than 4.5% by weight. If over 5% by weight, the viscosity tends to be too high, and adsorbing component tends to be buried in the binder, thus lowering the ability to remove reducing sulfur compounds.

The anticorrosion composition according to the present invention may be an aqueous solution or a water dispersion. Its pH value is preferably not less than 1 and less than 5, more preferably not less than 4 and not more than 4.9. If the pH value is 5 or over, the physical properties of the composition tend to be unstable, so that its performance deteriorates with time. If the pH value is 4.9 or less, it is possible to ensure stability more reliably. The pH value of less than 1 is not practical. If the pH value is 4 or over, it is possible to reliably ensure the adsorbing ability.

The anticorrosion composition according to this invention may further contain dispersants and viscoelasticity adjusters. Specifically, it may further contain nonionic surfactants, cationic surfactants, anionic surfactants, and/or bi-ionic surfactants. These additives will stabilize viscosity and the amount of the composition applied. If these additives are added, their solid content based on 100% by weight of the aqueous composition is preferably not more than 10% by weight, more preferably not more than 8% by weight. If over 10% by weight, the composition will be so high in viscosity that it will be difficult to apply it. In order to obtain a clear effect of the addition of viscoelasticity adjusters, their content is preferably not less than 0.1% by weight, more preferably not less than 0.5% by weight. If less than 0.1% by weight, the expected effect is scarcely achievable.

When the anticorrosion composition according to the present invention is used to absorb reducing sulfur compounds, because this compound has improved ability to absorb reducing sulfur compounds, it can sufficiently absorb such compounds without the need to use fine powder of activated charcoal. But fine powder of activated charcoal or pigments such as carbon black can be used, too, without any trouble. By using such substances, it is possible to identify the paper on which the composition is applied. But the addition of these substance will not influence the anticorrosive properties themselves.

The solid content of the anticorrosion composition according to the invention is preferably not more than 50% by weight, more preferably not more than 40% by weight, in an aqueous solution or water dispersion. If over 50% by weight, its concentration is so high that it is difficult to apply the composition. Also, the above solid content is preferably not less than 3% by weight, more preferably not less than 5% by weight. If less than 3% by weight, too large an amount of water content has to be evaporated in order to apply a necessary amount of the solid content, as will be described later, thus making it more difficult to produce an anticorrosion fiberboard.

In making the anticorrosion composition according to the invention, their components are preferably dispersed beforehand so that they can be prepared easily.

By applying the anticorrosion composition according to the invention to a fiberboard, an anticorrosion fiberboard is produced which can absorb and remove reducing sulfur compounds. The composition can be applied by coating, spraying, immersing or printing. Among these methods, printing such as gravure coating using a gravure printing machine is preferable because printing allows adjustment of the amount of the composition applied.

Fiberboards usable in the present invention include plain paper, coated paper, linerboard, corrugated fiberboard sheet, fiberboard for paperware, and other fiberboards. Linerboard includes liners such as kraft liner, jute liner and liners for interior decoration, and corrugating medium such as semi-corrugating medium and repulped medium. Fiberboards for paperware include white paperboard such as manila board and white lined chipboard, straw board, chipboard and colored board. Other fiberboards include core paper and wrapping paper. These fiberboards contain sulfur compounds such as kraft paper, and produce reducing sulfur compounds. In view of the fact that such fiberboards are used for packaging, such fiberboards preferably weigh, before the application of the composition or impregnation with the composition, not less than 40 g/m$^2$.

The anticorrosion composition according to the present invention is applied to a fiberboard preferably in an amount of not less than 1 g/m$^2$, more preferably not less than 5 g/m$^2$. If less than 1 g/m$^2$, this amount is too small. Also, this amount is preferably not more than 100 g/m$^2$, more preferably not more than 80 g/m$^2$. If over 100 g/m$^2$, the composition is excessive in amount, and also because the content of water that has to be evaporated after application is excessive, a large amount of calorie is needed.

The dry weight of the solid content of the composition applied to fiberboards is preferably not less than 0.1 g/m$^2$, more preferably not less than 0.5 g/m$^2$. If less than 0.1 g/m$^2$, this amount is so small that the composition cannot sufficiently absorb and remove reducing sulfur compounds. Also, this dry weight is preferably not more than 50 g/m$^2$, more preferably not more than 40 g/m$^2$. If over 50 g/m$^2$, the ability to absorb and remove reducing sulfur compounds does not increase in proportion to the amount applied. Thus, using such a large amount is wasteful, and also could deteriorate the physical properties of the fiberboards.

The anticorrosion fiberboard according to this invention can absorb and remove reducing sulfur compounds that contact the fiberboard. Such reducing sulfur compounds may be ones produced from outside or inside the fiberboard. In particular, by absorbing and removing reducing sulfur compounds produced from inside the fiberboard, before being diffused into the atmosphere, it is possible to prevent reducing sulfur compounds originating from the fiberboard from adhering to and corroding the contents of the package. The fiberboard can also absorb and remove any reducing sulfur compounds that are already present in the atmosphere before adhering to the contents of the package. Thus, in order to efficiently absorb and remove reducing sulfur compounds, thereby efficiently preventing corrosion of the contents of the package, it is preferable to use the anticorrosion fiberboard according to the present invention for the inner liner of the anticorrosion corrugated fiberboard, i.e. the liner that faces the contents of the package. With this arrangement, it is possible to efficiently prevent corrosion of industrial products and parts when these industrial products and parts are stored or transported in a packaging box made of this corrugated fiberboard.

EXAMPLES

The present invention is now described in more detail with reference to examples. First, description is made of measuring methods in Examples of the invention and Comparative Examples.

(Liquid Property Test)

Anticorrosion compositions of various compositions were prepared, and stored at 40° C. for 7 days. Before and after they were stored, their liquid properties, i.e. existence of precipitates, and changes in liquid color, pH value and viscosity were determined. The pH value was measured by the "pH measuring method" under JIS-Z-8802. The viscosity was measured using a B type viscometer made by Tokimec Inc. at a temperature of 23° C. It is preferable that no precipitates be observed. Thus, for any example in which precipitates were observed, the symbol X is affixed. Also, it is preferable that no color changes occur. Thus, for any example in which color change is observed, the symbol Δ is affixed if the degree of such color change is low, and the symbol X is affixed if the degree of color change is high.

(Linerboard Property Test)

For anticorrosion linerboards prepared in the same manner as those prepared for the below-described absorbing/removing ability test, existence of flaking of compositions when prepared, and changes in color and the absorbing/removing ability after they were stored at 23° C. for one month were observed. In Table 2, for any example in which there was a problem in any of flaking, absorbing/removing ability and color change of the linerboard, the symbol X is used in the item "linerboard property".

(Absorbing/Removing Ability Test)

Anticorrosion compositions of Examples of the invention and Comparative Examples were applied to linerboard (RKA 220, made by Rengo Co., Ltd., weight: 220 g/m$^2$) in the amount of 40 g/m$^2$ using a bar coater to obtain anticorrosion linerboards.

The thus obtained anticorrosion linerboards were cut to 20 cm×20 cm, and left in a desiccator containing 120 ppm of hydrogen sulfide gas and having a capacity of 11.4 liters, at 23° C. Then, 10, 30 and 180 minutes later, the concentration of hydrogen sulfide in the desiccator was measured using a gas detecting tube (type 120SB, made by Komyo Rikagaku Kogyo K.K.) to detect the amount of reduction of hydrogen sulfide.

180 minutes later, if the amount of reduction is less than 100 ppm, the symbol X is given, and if the amount of reduction is not less than 100 ppm and less than 120 ppm, the symbol Δ is given. The symbol ○ is given if the amount of reduction is 120 ppm (i.e. the hydrogen sulfide gas has been completely absorbed) 180 minutes later, but less than 120 ppm 10 and 30 minutes later. (But the symbol Δ is given if the amount of reduction is less than 70 ppm 10 minutes later, or less than 100 ppm 30 minutes later even if the amount of reduction is 120 ppm 180 minutes later.) If the amount of reduction is 120 ppm 10 minutes later, the symbol ◎ is given.

(Corrosion Test)

As in the above-described absorbing/removing ability test, the respective anticorrosion compositions were applied to A-flute double faced corrugated fiberboards (construction: RKA220/KS120/RKA220). With silver wires (made by Nagai Kinzoku Kogyosho K.K., not less than 99.95% pure silver) sandwiched between the thus produced corrugated fiberboard sheets, they were left for one month in an environment of 70° C. in temperature and 95% RH in humidity. Then, they were visually observed for corrosion. The symbol ◎ is given to any example which is free of corrosion. The symbol ○ is given to any example which has a slight haze. The symbol X is given to any example which suffered color change or corrosion.

(Test for Liberation of Absorbed Gas)

Linerboards obtained in the respective examples of the invention and comparative examples were subjected to pretreatment under the same conditions as used in the above-described absorbing/removing ability test. After taking them out of the desiccator, they were sealed in a sealed glass container and left for 2 hours at 70° C. Then, measurement was made using a gas detecting tube (type 120U, made by Komyo Rikagaku Kogyo K.K.). The symbol ○ is given to any example from which no gas was detected (less than 0.05 ppm), and the symbol X is given to any example from which gas was detected (not less than 0.05 ppm). In the table, this test item is indicated as "gas absorption/liberation".

Description is now made of raw materials used:

<Water-soluble Inorganic Acid Salts>

Copper sulfate pentahydrate . . . made by Wako Pure Chemical Industries, Ltd.: Reagent chemical (molecular weight: not more than 249.69; hereinafter referred to as "copper sulfate")

Copper chloride dihydrate . . . made by Kishida Chemical Co., Ltd.: Reagent chemical (molecular weight: not more than 170.48; hereinafter referred to as "copper chloride")

Tin chloride . . . made by Wako Pure Chemical Industries, Ltd.: Reagent chemical (molecular weight: 189.62)

<Alkaline Components>

Sodium hydroxide . . . made by Kishida Chemical Co., Ltd.: Reagent chemical (molecular weight: 40.00)

Ammonium water . . . made by Wako Pure Chemical Industries, Ltd. (25% by weight of aqueous solution; molecular weight: 17.03)

Sodium carbonate . . . made by Wako Pure Chemical Industries, Ltd.: Primary reagent (molecular weight: 105.99)

Sodium citrate dihydrate . . . made by Wako Pure Chemical Industries, Ltd. (molecular weight: 294.10)

<Binders>

Styrene-butadiene latex (SBR) . . . made by Asahi Kasei Corporation: L4700, concentration of water dispersion: 50% by weight Styrene-butadiene latex (SBR) . . . made by Nippon A & L Inc.: F7Z20, concentration of water dispersion: 50% by weight Methylcellulose . . . made by Kishida Chemical Co., Ltd.: 1% by weight aqueous solution of methylcellulose 400 for chemical use (indicated as "1% MC" in the table)

Polyvinyl alcohol . . . made by Kuraray Co., Ltd.: Poval 117, 5% by weight aqueous solution (indicated as "5% PVA" in the table)

Polyurethane resin . . . made by Mitsui Takeda Chemical Industries, Ltd.: Takelac W6061, 30% by weight <Viscoelasticity Adjusters>

SN thickener 607 made by San Nopco Limited, 40% by weight (indicated as "SN607" in the table)

Adekanol UH420 made by Adeka Corporation, 30% by weight (indicated as "UH420" in the table)

<Others>

Fine powder of activated charcoal . . . made by Japan EnviroChemicals, Ltd.: Shirasagi C, average particle diameter: 10 μm <Inorganic Compounds for Comparative Examples>

Zinc sulfate heptahydrate . . . made by Wako Pure Chemical Industries, Ltd.: Reagent chemical (molecular weight: not more than 287.56, indicated as "zinc sulfate" in the table)

Copper oxide . . . made by Kishida Chemical Co., Ltd. (molecular weight: 79.55)

Copper hydroxide . . . made by Wako Pure Chemical Industries, Ltd. (molecular weight: 97.56)

<Consideration of the Equivalent Ratio a:b>

Example 1 of the Invention

An aqueous composition was obtained by mixing 3.72 parts by weight of copper sulfate as a water-soluble inorganic acid salt (a), 0.15 parts by weight of sodium hydroxide as an alkaline component (b) (equivalent ratio a:b=2:0.25), 1 part by weight of L4700, which is SBR, as a binder (c), 12.0 parts by weight of SN607 as a viscoelasticity adjuster, and 83.1 parts by weight of water. The aqueous composition obtained had a total solid content of 7.83% by weight based on the entire composition, a viscosity of 40 mPa·s, and a pH value of 4.2. The thus obtained aqueous composition was applied to the abovementioned linerboard to obtain an anticorrosion fiberboard. For the composition and the anticorrosion fiberboard, the composition is shown in Table 1 and the measurement results are shown in Table 2. The numerical values in circles in the table represent the number of molecules of hydrated water.

TABLE 1

| | Equivalent | Inorganic acid salt (inorganic compound)(a)(containing equivalent amount 29.8 m/100 g liquid) | | Alkaline component (b) | | | |
|---|---|---|---|---|---|---|---|
| | ratio a:b | Substance | Parts by weight | Substance | Parts by weight | Substance | Parts by weight |
| Example 1 of the invention | 2:0.25 | Copper sulfate⑤ | 3.72 | NaOH | 0.15 | — | 0 |

TABLE 1-continued

| | | | | | | | |
|---|---|---|---|---|---|---|---|
| Example 2 of the invention | 2:0.6 | Copper sulfate⑤ | 3.72 | NaOH | 0.36 | — | 0 |
| Example 3 of the invention | 2:1.5 | Copper sulfate⑤ | 3.72 | NaOH | 0.89 | — | 0 |
| Comparative Example 1 | 2:O | Copper sulfate⑤ | 58.0 | — | 0 | — | 0 |
| Comparative Example 2 | 2:O | Copper sulfate⑤ | 3.72 | — | 0 | — | 0 |
| Comparative Example 3 | 2:0.15 | Copper sulfate⑤ | 3.72 | NaOH | 0.09 | — | 0 |
| Comparative Example 4 | 2:2.5 | Copper sulfate⑤ | 3.72 | NaOH | 1.49 | — | 0 |
| Comparative Example 5 | 2:0.6 | Copper oxide | 1.19 | NaOH | 0.36 | — | 0 |
| Comparative Example 6 | 2:0.6 | Copper hydroxide | 1.45 | NaOH | 0.36 | — | 0 |
| Example 4 of the invention | 2:1 | Copper chloride② | 39.6 | NaOH | 9.29 | — | 0 |
| Example 5 of the invention | 2:1 | Tin chloride | 44.1 | NaOH | 9.29 | — | 0 |
| Comparative Example 7 | 2:0.6 | Zinc sulfate⑦ | 66.8 | NaOH | 5.57 | — | 0 |
| Comparative Example 8 | 2:O | Zinc sulfate⑦ | 66.8 | — | 0.00 | — | 0 |
| Example 6 of the invention | 2:0.6 | Copper sulfate⑤ | 58.0 | Ammonia water | 9.49 | — | 0 |
| Example 7 of the invention | 2:1.2 | Copper sulfate⑤ | 58.0 | $Na_2CO_3$ | 14.77 | — | 0 |
| Comparative Example 9 | 2:0.9 | Copper sulfate⑤ | 3.72 | 0.1N—NaOH | 32.7 | Citric acid Na② | 1.0 |
| Comparative Example 10 | 2:0.9 | Zinc sulfate⑦ | 4.28 | 0.1N—NaOH | 32.7 | Citric acid Na② | 1.0 |
| Comparative Example 11 | 2:2.2 | Copper sulfate⑤ | 3.72 | NaOH | 0.91 | Citric acid Na② | 1.0 |
| Example 8 of the invention | 2:0.6 | Copper sulfate⑤ | 58.0 | NaOH | 5.57 | — | 0 |
| Example 9 of the invention | 2:0.6 | Copper sulfate⑤ | 58.0 | NaOH | 5.57 | — | 0 |
| Example 10 of the invention | 2:0.6 | Copper sulfate⑤ | 58.0 | NaOH | 5.57 | — | 0 |
| Example 11 of the invention | 2:0.6 | Copper sulfate⑤ | 3.72 | NaOH | 0.36 | — | 0 |

| | Binder (c) | | Activated charcoal | Viscoelasticity adjuster | | Water | Total | Concentration of solid |
|---|---|---|---|---|---|---|---|---|
| | Type | Parts by weight | Parts by weight | Type | Parts by weight | Parts by weight | Parts by weight | content weight % |
| Example 1 of the invention | L4700 | 1 | 0 | SN607 | 12.0 | 83.1 | 100.0 | 7.83% |
| Example 2 of the invention | L4700 | 1 | 0 | SN607 | 12.0 | 82.9 | 100.0 | 8.03% |
| Example 3 of the invention | L4700 | 1 | 0 | SN607 | 12.0 | 82.4 | 100.0 | 8.57% |
| Comparative Example 1 | F7Z20 | 6 | 1.4 | SN607 | 327.3 | 1166.6 | 1559.3 | 11.06% |
| Comparative Example 2 | L4700 | 1 | 0 | SN607 | 12.0 | 83.3 | 100.0 | 7.68% |
| Comparative Example 3 | L4700 | 1 | 0 | SN607 | 12.0 | 83.2 | 100.0 | 7.77% |
| Comparative Example 4 | L4700 | 1 | 0 | SN607 | 12.0 | 81.8 | 100.0 | 9.17% |
| Comparative Example 5 | L4700 | 1 | 0 | SN607 | 12.0 | 85.5 | 100.0 | 6.85% |
| Comparative Example 6 | L4700 | 1 | 0 | SN607 | 12.0 | 85.2 | 100.0 | 7.11% |
| Example 4 of the invention | L4700 | 6 | 0 | SN607 | 327.3 | 1177.1 | 1559.3 | 11.19% |
| Example 5 of the invention | L4700 | 6 | 0 | SN607 | 327.3 | 1172.7 | 1559.3 | 12.01% |
| Comparative Example 7 | L4700 | 6 | 0 | SN607 | 327.3 | 1152.2 | 1559.3 | 11.35% |
| Comparative Example 8 | L4700 | 6 | 0 | SN607 | 327.3 | 1157.8 | 1559.3 | 10.99% |
| Example 6 of the invention | L4700 | 6 | 0 | SN607 | 327.3 | 1157.1 | 1559.3 | 11.12% |
| Example 7 of the invention | L4700 | 6 | 0 | SN607 | 327.3 | 1151.8 | 1559.3 | 11.91% |
| Comparative | — | 0 | 0 | — | 0 | 62.5 | 100.0 | 4.56% |

TABLE 1-continued

| | | | | | | | | |
|---|---|---|---|---|---|---|---|---|
| Example 9 | | | | | | | | |
| Comparative Example 10 | — | 0 | 0 | — | 0 | 62.0 | 100.0 | 4.59% |
| Comparative Example 11 | — | 0 | 0 | — | 0 | 94.4 | 100.0 | 4.16% |
| Example 8 of the invention | L4700 | 6 | 0 | SN607 | 327.3 | 1162.4 | 1559.3 | 11.32% |
| Example 9 of the invention | 1% MC | 333.3 | 0 | — | 0.0 | 1161.0 | 1559.3 | 2.95% |
| Example 10 of the invention | 5% PVA | 66 | 0 | SN607 | 267.3 | 1161.0 | 1559.3 | 9.80% |
| Example 11 of the invention | W6061 | 1 | 0 | UH420 | 12.0 | 82.9 | 100.0 | 6.63% |

TABLE 2

| | Equivalent ratio | Removing ability (120 ppm, 23° C.) 10 min. | 30 min. | 180 min. | Removing ability | Gas absorption/ liberation | Corrosion test |
|---|---|---|---|---|---|---|---|
| Example 1 of the invention | 2:0.25 | 75 | 105 | 120 | ○ | ○ | ○ |
| Example 2 of the invention | 2:0.6 | 120 | 120 | 120 | ◎ | ○ | ◎ |
| Example 3 of the invention | 2:1.5 | 120 | 120 | 120 | ◎ | ○ | ◎ |
| Comparative Example 1 | 2:O | 40 | 60 | 95 | X | ○ | X |
| Comparative Example 2 | 2:O | 30 | 50 | 90 | X | ○ | X |
| Comparative Example 3 | 2:0.15 | 45 | 65 | 105 | Δ | ○ | X |
| Comparative Example 4 | 2:2.5 | 45 | 65 | 100 | Δ | ○ | X |
| Comparative Example 5 | 2:0.6 | 15 | 25 | 30 | X | ○ | X |
| Comparative Example 6 | 2:0.6 | 15 | 35 | 50 | X | ○ | X |
| Example 4 of the invention | 2:1 | 120 | 120 | 120 | ◎ | ○ | ○ |
| Example 5 of the invention | 2:1 | 70 | 100 | 120 | ○ | ○ | ○ |
| Comparative Example 7 | 2:0.6 | 60 | 90 | 110 | Δ | X | X |
| Comparative Example 8 | 2:O | 35 | 60 | 95 | X | X | X |
| Example 6 of the invention | 2:0.6 | 70 | 100 | 120 | ○ | ○ | ○ |
| Example 7 of the invention | 2:1.2 | 120 | 120 | 120 | ◎ | ○ | ◎ |
| Comparative Example 9 | 2:0.9 | 40 | 60 | 95 | X | ○ | X |
| Comparative Example 10 | 2:0.9 | 35 | 55 | 95 | X | X | X |
| Comparative Example 11 | 2:2.2 | 50 | 65 | 105 | Δ | ○ | X |
| Example 8 of the invention | 2:0.6 | 120 | 120 | 120 | ◎ | ○ | ◎ |
| Example 9 of the invention | 2:0.6 | 120 | 120 | 120 | ◎ | ○ | ◎ |
| Example 10 of the invention | 2:0.6 | 120 | 120 | 120 | ◎ | ○ | ◎ |
| Example 11 of the invention | 2:0.6 | 120 | 120 | 120 | ◎ | ○ | ◎ |

| | Liquid property | Liquid pH | Viscosity | Linerboard property | Flaking | Change in property | Color change of linerboard |
|---|---|---|---|---|---|---|---|
| Example 1 of the invention | ○ | 4.2 | 40 | ○ | | | |
| Example 2 of the invention | ○ | 4.5 | 50 | ○ | | | |
| Example 3 of the invention | ○ | 4.9 | 300 | ○ | | | |

TABLE 2-continued

| | | | | | | | |
|---|---|---|---|---|---|---|---|
| Comparative Example 1 | ○ | 4.1 | 300 | ○ | | | |
| Comparative Example 2 | ○ | 4.1 | 30 | ○ | | | |
| Comparative Example 3 | ○ | 4.1 | 35 | ○ | | | |
| Comparative Example 4 | X color change | 12.0 | 5000 | X | | Deteriorated | Yes |
| Comparative Example 5 | X precipitate | 11.6 | 35 | ○ | | | |
| Comparative Example 6 | X precipitate | 11.6 | 35 | X | | Deteriorated | |
| Example 4 of the invention | ○ | 4.1 | 300 | ○ | | | |
| Example 5 of the invention | ○ | 2.3 | 280 | ○ | | | |
| Comparative Example 7 | ○ | 6.2 | 390 | ○ | | | |
| Comparative Example 8 | ○ | 4.9 | 285 | ○ | | | |
| Example 6 of the invention | ○ | 4.6 | 305 | ○ | | | |
| Example 7 of the invention | ○ | 4.8 | 350 | ○ | | | |
| Comparative Example 9 | Δ color change | 3.8 | 5 | X | Yes | | |
| Comparative Example 10 | ○ | 6.9 | 5 | X | Yes | | |
| Comparative Example 11 | X color change | 12.5 | 20 | X | Yes | Deteriorated | Yes |
| Example 8 of the invention | ○ | 4.3 | 345 | ○ | | | |
| Example 9 of the invention | ○ | 4.3 | 305 | ○ | | | |
| Example 10 of the invention | ○ | 4.4 | 300 | ○ | | | |
| Example 11 of the invention | ○ | 4.5 | 40 | ○ | | | |

Example 2 of the Invention

Using the same components as in Example 1 except that the content of sodium hydroxide was changed to 0.36 parts by weight (equivalent ratio a:b=2:0.6) and the water content was correspondingly reduced to 82.9 parts by weight, an aqueous composition having a total solid content of 8.03% by weight, a viscosity of 50 mPa·s, and a pH value of 4.5 was obtained. The thus obtained composition was applied to fiberboard. Its composition is shown in Table 1 and measurement results are shown in Table 2.

Example 3 of the Invention

Using the same components as in Example 1 except that the content of sodium hydroxide was changed to 0.89 parts by weight (equivalent ratio a:b=2:1.5) and the water content was correspondingly reduced to 82.4 parts by weight, an aqueous composition having a total solid content of 8.57% by weight, a viscosity of 300 mPa·s, and a pH value of 4.9 was obtained. The thus obtained composition was applied to fiberboard. Its composition is shown in Table 1 and measurement results are shown in Table 2.

Comparative Example 1

By mixing together 58.0 parts by weight of copper sulfate, 6 parts by weight of F7Z20, which is SBR, as a binder, 1.4 parts by weight of activated charcoal, 327.3 parts by weight of SN607 as a viscoelasticity adjuster, and 1166.6 parts by weight of water, with no sodium hydroxide added, an aqueous composition having a total solid content of 11.06% by weight based on the entire composition, a viscosity of 300 mPa·s, and a pH value of 4.1 was obtained. The thus obtained composition was applied to fiberboard. Its composition is shown in Table 1 and measurement results are shown in Table 2.

Comparative Example 2

Using the same components as in Example 1 except that sodium hydroxide was not added (equivalent ratio a:b=2:0) and the water content was correspondingly increased to 83.3 parts by weight, an aqueous composition having a total solid content of 7.68% by weight, a viscosity of 30 mPa·s, and a pH value of 4.1 was obtained. The thus obtained composition was applied to fiberboard. Its composition is shown in Table 1 and measurement results are shown in Table 2.

Comparative Example 3

Using the same components as in Example 1 except that the content of sodium hydroxide was changed to 0.09 parts by weight (equivalent ratio a:b=2:0.15) and the water content was correspondingly increased to 83.0 parts by weight, an aqueous composition having a total solid content of 7.77% by weight, a viscosity of 35 mPa·s, and a pH value of 4.1 was obtained. The thus obtained composition was applied to fiberboard. Its composition is shown in Table 1 and measurement results are shown in Table 2.

Comparative Example 4

Using the same components as in Example 1 except that the content of sodium hydroxide was changed to 1.49 parts by weight (equivalent ratio a:b=2:2.5) and the water content was correspondingly increased to 81.6 parts by weight, an aqueous composition having a total solid content of 9.17% by weight, a viscosity of 5000 mPa·s, and a pH value of 12.0 was obtained. The thus obtained composition was applied to fiberboard. Its composition is shown in Table 1 and measurement results are shown in Table 2.

Comparative Example 5

Using the same components as in Example 1 except that instead of a sulfate as an inorganic acid salt, 1.19 parts by weight of copper oxide was used, 0.36 parts by weight of sodium hydroxide was added as an alkaline component (b) (if the copper oxide is regarded as the component (a), the equivalent ratio a:b=2:0.6), and the water content was correspondingly changed to 85.5 parts by weight, an aqueous composition having a total solid content of 6.85% by weight, a viscosity of 35 mPa·s, and a pH value of 11.6 was obtained. The thus obtained composition was applied to fiberboard. Its composition is shown in Table 1 and measurement results are shown in Table 2.

Comparative Example 6

Using the same components as in Comparative Example 5 except that instead of copper oxide, 1.45 parts by weight of copper hydroxide was used, 0.36 parts by weight of sodium hydroxide was added as an alkaline component (b) (if the copper hydroxide is regarded as the component (a), the equivalent ratio a:b=2:0.6), and the water content was correspondingly changed to 85.2 parts by weight, an aqueous composition having a total solid content of 7.11% by weight, a viscosity of 35 mPa·s, and a pH value of 11.6 was obtained. The thus obtained composition was applied to fiberboard. Its composition is shown in Table 1 and measurement results are shown in Table 2.

(Results)

For any of Examples 1 to 3 of the invention, in which the equivalent ratio of the water-soluble inorganic acid salt (a) and the alkaline component (b) is in the range of 2:0.2 to 2:2, good results were obtained. For Comparative Examples 1 and 2, in which no alkaline component (b) was used, it was impossible to remove reducing sulfur compounds, so that test specimens corroded. For Comparative Example 3, in which the content of the alkaline component (b) was insufficient, reducing sulfur compounds were not sufficiently removed, so that test specimens corroded. For Comparative Example 4, in which the content of the alkaline component (b) was excessive, the linerboard suffered degeneration. Also, because reducing sulfur compounds were not sufficiently removed, so that test specimens corroded. For Comparative Examples 5 and 6, in which copper oxide and copper hydroxide were used instead of an inorganic acid salt, reducing sulfur compounds were not sufficiently removed, so that test specimens corroded.

<Consideration About Inorganic Acid Salts>

Example 4 of the Invention

Except that instead of copper sulfate, 39.6 parts by weight of copper chloride was used, the content of sodium hydroxide was changed to 9.29 parts by weight (equivalent ratio a:b=2:1), the content of L4700 as a binder was changed to 6 parts by weight, and the water content was changed to 1177.1 parts by weight, an aqueous composition was obtained in the same manner as in Example 1 of the invention. The composition thus obtained had a total solid content of 11.19% by weight, a viscosity of 300 mPa·s, and a pH value of 4.1 was obtained. The thus obtained composition was applied to fiberboard. Its composition is shown in Table 1 and measurement results are shown in Table 2.

Example 5 of the Invention

Except that instead of copper sulfate, 44.1 parts by weight of tin chloride was used, the content of sodium hydroxide was changed to 9.29 parts by weight (equivalent ratio a:b=2:1), the content of L4700 as a binder was changed to 6 parts by weight, and the water content was changed to 1172.7 parts by weight, an aqueous composition having a total solid content of 12.01% by weight was obtained in the same manner as in Example 1 of the invention. The thus obtained composition was applied to fiberboard. Its composition is shown in Table 1 and measurement results are shown in Table 2.

Comparative Example 7

Except that instead of copper sulfate, 66.8 parts by weight of zinc sulfate was used, the content of sodium hydroxide was changed to 5.57 parts by weight (equivalent ratio a:b=2:0.6), the content of L4700 as a binder was changed to 6 parts by weight, the content of the viscoelasticity adjuster was changed to 327.3, and the water content was changed to 1153.6 parts by weight, a composition having a total solid content of 11.35% by weight was obtained in the same manner as in Example 1 of the invention. The thus obtained composition was applied to fiberboard. Its composition is shown in Table 1 and measurement results are shown in Table 2.

Comparative Example 8

Except that sodium hydroxide was not used, and the water content was changed to 1159.2 parts by weight, a composition having a total solid content of 10.99% by weight was obtained in the same manner as in Comparative Example 7. The thus obtained composition was applied to fiberboard. Its composition is shown in Table 1 and measurement results are shown in Table 2.

(Results)

When chlorides of copper and tin are used as water-soluble inorganic acid salts (Examples 4 and 5 of the invention), the ability to remove reducing sulfur composition was high. But when zinc was used (Comparative Example 7), although it was possible to remove reducing sulfur compounds, it was impossible to completely prevent corrosion. Reducing sulfur compounds that have been absorbed had been liberated. Further, without an alkaline component (Comparative Example 8), the ability to remove reducing sulfur compounds was insufficient.

<Consideration of Alkaline Components (b)>

Example 6 of the Invention

An aqueous composition was obtained by mixing 58.0 parts by weight of copper sulfate as a water-soluble inorganic acid salt (a), 9.49 parts by weight of ammonia water as an alkaline component (b) (equivalent ratio a:b=2:0.6), 6 parts by weight of L4700, which is SBR, as a binder (c), 327.3 parts by weight of SN607 as a viscoelasticity adjuster, and 1158.5 parts by weight of water, with no activated charcoal added. The aqueous composition obtained had a total solid content of 11.12% by weight based on the entire composition, a viscosity of 305 mPa·s, and a pH value of 4.6. The thus obtained aqueous composition was applied to fiberboard. Its composition is shown in Table 1 and measurement results are shown in Table 2.

Example 7 of the Invention

Except that instead of ammonia water, 14.77 parts by weight of sodium hydrogen carbonate was used as an alkaline component (b), and the water content was changed to 1153.2 parts by weight, a composition having a total solid content of 11.91% by weight, a viscosity of 350 mPa·s, and a pH value of 4.8 was obtained in the same manner as in Example 6 of the invention. The thus obtained composition was applied to fiberboard. Its composition is shown in Table 1 and measurement results are shown in Table 2.

(Results)

It was discovered that provided any alkaline component (b), which is not limited to sodium hydroxide, is present in a suitable equivalent ratio, it is possible to suitably remove reducing sulfur compounds.

<Consideration when Only an Alkaline Component and a Water-soluble Inorganic Acid Salt are Used with No Binder>

Comparative Example 9

100 parts by weight of a composition (solid content: 4.56%) was obtained by mixing 3.72 parts by weight of copper sulfate as a water-soluble inorganic acid salt (a), 32.7 parts by weight of an aqueous solution of 0.1 N sodium hydroxide and 1.0 part by weight of sodium citrate dihydrate as alkaline components (b) (equivalent ratio a:b=2:0.9), and 62.5 parts by weight of water, with no binder (c), activated charcoal and viscoelasticity adjuster added. The composition obtained had a viscosity of 5 mPa·s, and a pH value of 3.8. The thus obtained composition was applied to fiberboard. Its composition is shown in Table 1 and measurement results are shown in Table 2.

Comparative Example 10

Except that instead of copper sulfate, 4.28 parts by weight of zinc sulfate was used, and the water content was changed to 62.0 parts by weight, with the alkaline component (b) unchanged (equivalent ratio a:b=2:0.9), 100 parts by weight of a composition (solid content: 4.59%) having a viscosity of 5 mPa·s and a pH value of 6.9 was obtained in the same manner as in Comparative Example 9. The thus obtained composition was applied to fiberboard. Its composition is shown in Table 1 and measurement results are shown in Table 2.

Comparative Example 11

Except that instead of an aqueous solution of sodium hydroxide, 0.91 parts by weight of sodium hydroxide (equivalent ratio a:b=2:2.2), and the water content was changed to 94.4 parts by weight, a composition was obtained in the same manner as in Comparative Example 9. The composition obtained had a total solid content of 4.16% by weight based on 100 parts by weight of the entire composition, a viscosity of 20 mPa·s and a pH value of 12.5. The thus obtained composition was applied to fiberboard. Its composition is shown in Table 1 and measurement results are shown in Table 2.

(Results)

In any examples, because no binder (c) is contained, the ability to remove reducing sulfur compounds was insufficient. A change in color was observed in the compositions of Comparative Examples 9 and 11. Particularly for Comparative Example 11, a significant change in color was observed. Further, flaking occurred in any of the fiberboards. For Comparative Example 11, a change in color was observed even in the fiberboard.

<Consideration of Binders (c)>

Example 8 of the Invention 1559.3 parts by weight of a composition (solid content: 11.32%) was obtained by mixing 58.0 parts by weight of copper sulfate as a water-soluble inorganic acid salt (a), 5.57 parts by weight of sodium hydroxide as an alkaline component (b) (equivalent ratio a:b=2:0.6), 6 parts by weight of L4700 as a binder (c), 327.3 parts by weight of SN607 as a viscoelasticity adjuster, and 1162.4 parts by weight of water. The composition obtained had a viscosity of 345 mPa·s and a pH value of 4.3. The thus obtained composition was applied to fiberboard. Its composition is shown in Table 1 and measurement results are shown in Table 2.

Example 9 of the Invention

Except that instead of L4700, 333.3 parts by weight of an aqueous solution of 1% by weight of methylcellulose was used, with no viscoelasticity adjuster added, and the water content was changed to 1162.4 parts by weight, 1559.3 parts by weight of a composition (solid content: 2.95%) was obtained in the same manner as in Example 8 of the invention. The composition obtained had a viscosity of 305 mPa·s and a pH value of 4.3. The thus obtained composition was applied to fiberboard. Its composition is shown in Table 1 and measurement results are shown in Table 2.

Example 10 of the Invention

Except that instead of L4700, 66 parts by weight of an aqueous solution of 5% polyvinyl alcohol was used, the content of SN607 was changed to 267.3 parts by weight, and the water content was changed to 1162.4 parts by weight, 1559.3 parts by weight of a composition (solid content: 9.80%) was obtained in the same manner as in Example 8 of the invention. The composition obtained had a viscosity of 300 mPa·s and a pH value of 4.4. The thus obtained composition was applied to fiberboard. Its composition is shown in Table 1 and measurement results are shown in Table 2.

Example 11 of the Invention 100 parts by weight of a composition (solid content: 6.63%) was obtained by mixing 3.72 parts by weight of copper sulfate as a water-soluble inorganic acid salt (a), 0.36 parts by weight of sodium hydroxide as an alkaline component (b), 1 part by weight of W6061 as a binder (c), 12.0 parts by weight of UH420 as a viscoelasticity adjuster, and 82.9 parts by weight of water, with no activated charcoal added. The composition obtained had a viscosity of 40 mPa·s and a pH value of 4.5. The thus obtained composition was applied to fiberboard. Its composition is shown in Table 1 and measurement results are shown in Table 2.

(Results)

It was possible to obtain compositions having a high ability to remove reducing sulfur compounds even when different binders are used.

<Consideration of Corrosion of Electric Devices>

Example 12 of the Invention

As test pieces, copper wirings of flexible printed circuit boards (FPC) for liquid crystal modules, and diodes having silver terminals were used. A coated linerboard (RKA220) was prepared to which the aqueous composition of Example 2 of the invention was applied by a gravure printing machine. Using this linerboard as a liner, an AB-flute double wall corrugated fiberboard sheet was prepared. Using this sheet, a type 0201 corrugated fiberboard case (JIS-Z-1507) was formed. In this case, the test pieces were packaged and left in an environment of 60° C. and 95% RH for one month. The case was then opened to check the state of corrosion of the test pieces. No corrosion was found on the copper wirings. Neither corrosion nor any change in color was observed on the silver terminals.

Comparative Example 12

Using the composition of Comparative Example 10, a test was conducted in the same manner as in Example 12 of the invention. As a result, corrosion was found on the copper wirings. There were portions on the silver terminals where their colors changed.

Comparative Example 13

A test was conducted in the same manner as in Example 12 of the invention except that no composition was applied. As a result, significant corrosion was observed on the copper wirings, and a significant change in color was observed on the silver terminals.

<Test on the Ability to Absorb Methyl Mercaptan>

Example 13 of the Invention

The fiberboard prepared in Example 2 of the invention was put in a desiccator in which instead of hydrogen sulfide, 120 ppm of methyl mercaptan (headspace gas of a methyl mercaptan sodium solution (made by Tokyo Chemical Industry Co., Ltd.; 15% by weight solution)). The fiberboard was subjected to the same test as the absorbing/removing ability test. As a result, it was possible to remove methyl mercaptan by 75 ppm in 10 minutes, 105 ppm in 30 minutes and 120 ppm in 180 minutes. Thus, it was discovered that this composition had a sufficient ability to remove methyl mercaptan too. The detecting tube used was type 164SA (made by Komyo Rikagaku Kogyo K.K.).

Comparative Example 14

The fiberboard prepared in Comparative Example 2 was put in a desiccator in which instead of hydrogen sulfide, 120 ppm of methyl mercaptan as used in Example 13 of the invention, and subjected to the same test as the absorbing/removing ability test. As a result, it was possible to remove methyl mercaptan only by 30 ppm in 10 minutes, 50 ppm in 30 minutes and 80 ppm in 180 minutes. Thus, the ability to remove methyl mercaptan was insufficient.

What is claimed is:

1. An anticorrosion fiberboard to which an anticorrosion composition is applied, or which is impregnated with the anticorrosion composition, wherein the anticorrosion composition contains a water-soluble inorganic acid salt (a) containing at least one of copper and tin, an alkaline component (b), and a binder (c), wherein:

the equivalent ratio of the water-soluble inorganic acid salt (a) and the alkaline component (b) is 2:0.25 to 2:2, said alkaline component (b) contains at least one of sodium hydroxide, sodium carbonate and sodium hydrogen carbonate, and the anticorrosion composition does not contain activated charcoal.

2. An anticorrosion corrugated fiberboard formed of the anticorrosion fiberboard of claim 1.

3. An anticorrosion corrugated packaging box for use in storing or transporting industrial products or parts, said packaging box being formed of the anticorrosion corrugated fiberboard of claim 2.

* * * * *